United States Patent [19]

Matsuzaka et al.

[11] Patent Number: 4,687,435

[45] Date of Patent: Aug. 18, 1987

[54] PULSE COMBUSTOR

[75] Inventors: Takashi Matsuzaka, Fuji; Toshihiko Saito, Tokyo; Satoshi Hisaoka, Fujinomiya, all of Japan

[73] Assignee: Kabushiki Kaisha Toshiba, Kawasaki, Japan

[21] Appl. No.: 717,882

[22] Filed: Mar. 29, 1985

[30] Foreign Application Priority Data

Mar. 30, 1984 [JP] Japan ..... 59-46051[U]

[51] Int. Cl.[4] ..... F23C 11/04

[52] U.S. Cl. ..... 431/1; 137/516.15

[58] Field of Search ..... 431/1; 60/39.38, 39.39, 60/39.77, 39.78, 39.79, 39.8; 137/512, 512.1, 516.15

[56] References Cited

U.S. PATENT DOCUMENTS

| | | | |
|---|---|---|---|
| 2,898,978 | 8/1954 | Kitchen et al. | 431/1 |
| 3,005,485 | 10/1961 | Salgo et al. | 431/1 |
| 3,158,175 | 11/1964 | Jaklitsch | 137/512.1 X |
| 3,162,699 | 12/1964 | Sivyer | 137/512.1 X |
| 3,273,591 | 9/1966 | Stewart | 137/512.1 |
| 3,358,710 | 12/1967 | Page | 137/512.1 |
| 3,369,563 | 2/1968 | Deminger | 137/512.1 |
| 4,080,149 | 3/1978 | Wolfe | 431/1 |
| 4,278,106 | 7/1981 | Cunningham | 137/516.15 X |
| 4,457,691 | 7/1984 | Hisaoka et al. | 431/1 |

FOREIGN PATENT DOCUMENTS

| | | | |
|---|---|---|---|
| 146403 | 7/1936 | Fed. Rep. of Germany | 137/516.15 |
| 1240612 | 5/1967 | Fed. Rep. of Germany | 431/1 |
| 23354 | of 1911 | United Kingdom | 137/512.1 |
| 1097353 | 1/1968 | United Kingdom | 137/516.15 |

*Primary Examiner*—Margaret A. Focarino

*Attorney, Agent, or Firm*—Cushman, Darby & Cushman

[57] ABSTRACT

A pulse combustor has a casing in which a combustion chamber is defined. Air is supplied to the combustion chamber through an air supply pipe. A valve mechanism for controlling the air supply to the chamber is provided in the air supply pipe. The valve mechanism has a base plate with a plurality of air supply holes for the passage of air, and a flapper valve for opening and closing the air supply holes in accordance with the change of pressure inside the chamber. The flapper valve is composed of a plurality of ring-shaped segments with different diameters. These segments are arranged concentrically with one another.

15 Claims, 7 Drawing Figures

PULSE COMBUSTOR

BACKGROUND OF THE INVENTION

The present invention relates to a pulse combustor for pulsatively combusting fuel in a combustion chamber, and more specifically to a pulse combustor with a valve mechanism for controlling pulse combustion.

Pulse combustors of this type are generally provided with supply means for supplying air and fuel into a combustion chamber and a valve mechanism disposed in the combustion chamber or the up-stream side of the chamber. The valve mechanism, which serves as a one-way flow control valve for controlling the flow of air and fuel into the combustion chamber, includes a base plate disposed in the combustion chamber or the up-stream side of the chamber and having a plurality of gas supply holes, and a ring-shaped flapper valve, located on the base plate, for opening and closing the supply holes in accordance with the change of pressure inside the combustion chamber. At the start of the operation of the pulse combustor, air and fuel are fed into the combustion chamber by a blower, and ignited by an ignition plug to be deflagrated (or, caused to burn with intense heat). As a result, the pressure inside the combustion chamber increases to cause the flapper valve to be closed, so that the combustion gas is discharged through a tail pipe which communicates with the combustion chamber. When the combustion gas is exhausted, the pressure inside the combustion chamber becomes negative, so that the flapper valve is opened to allow the air and fuel to be automatically sucked into the combustion chamber. Also, part of the high-temperature gas discharged into the tail pipe flows back into the combustion chamber, and the air-fuel mixture gas int he combustion chamber is ignited and deflagrated b the high-temperature gas. Thereafter, the suction, ignition, expansion, and exhaust are automatically repeated for pulsative combustion.

When increasing the combustion volume in the prior art pulse combustors of this type, it is necessary to increase the volume of the combustion chamber and the number of air and fuel supply holes. Accordingly, the flapper valve is increased in size. Conventionally formed from a single plate, however, the flapper valve would become heavier with the increase of its size, resulting in unsmooth movement incompatible with pulse oscillation. Therefore, the combustion efficiency of the pulse combustor may be lowered, or the pulse oscillation would be interrupted. Since the surface area of the flapper valve is wide, various parts of the flapper valve act unevenly, resulting in the life of the flapper valve being shortened. Moreover, it would be rather difficult to start the operation of the pulse combustor.

Accordingly, the valve mechanism is conventionally divided into two or more segments. In this case, however, each segment requires all the essential components for an entire valve unit, including a base plate, flapper valve, valve guards, etc. As a result, the valve mechanism and hence the pulse combustor are increased in overall size and complicated in construction. Also, the segments would possibly interfere with one another, interrupting the pulse oscillation.

SUMMARY OF THE INVENTION

The present invention is contrived in consideration of these circumstances, and is intended to provide a pulse combustor capable of satisfactory pulse combustion despite an increase in combustion volume.

In order to achieve the above object, a pulse combustor according to the present invention comprises a casing having a combustion chamber therein, supply means for supplying air and fuel to the combustion chamber, and a valve mechanism for controlling the air and fuel supply to the combustion chamber, the valve mechanism including a base plate with a plurality of supply holes for the passage of air and/or fuel, and a flapper valve for opening and closing the supply holes in accordance with the change of pressure inside the combustion chamber, the flapper valve consisting of a plurality of ring-shaped segments with different diameters arranged concentrically.

According to the pulse combustor constructed in this manner, the flapper valve is formed of a plurality of segments, and each segment is light enough for smooth operation. Thus, satisfactory pulse oscillation is permitted, and the pulse combustor can be started with smoothness.

BRIEF DESCRIPTION OF THE DRAWINGS

FIGS. 1 to 4 show a pulse combustor according to one embodiment of the present invention, in which FIG. 1 is a side view showing an outline of the pulse combustor, FIG. 2 is a sectional view of an air-side valve mechanism, FIG. 3 is a plan view of a flapper valve, and FIG. 4 is an enlarged sectional view showing part of the valve mechanism;

DETAILED DESCRIPTION OF THE PREFERRED EMBODIMENTS

Embodiments of the present invention will now be described in detail with reference to the accompanying drawings.

Figure 1:
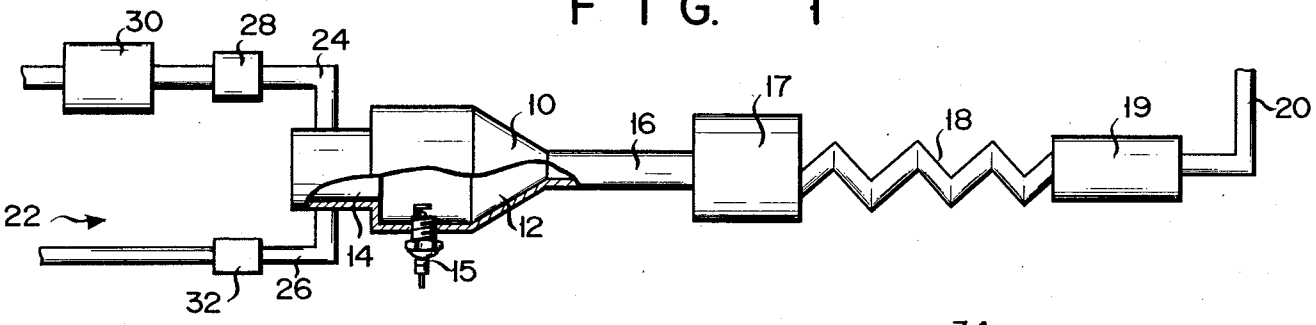

As shown in FIG. 1, the pulse combustor is provided with a casing 10 in which are defined a combustion chamber 12 and a mixing chamber 14 located on the upper-course side of the combustion chamber 12. An ignition plug 15 for starting the pulse combustor projects into the combustion chamber 12. The casing 10 is connected successively with a tail pipe 16 communicating with the combustion chamber 12, a decoupler 17, a heat exchanger 18, an exhaust muffler 19, and an exhaust pipe 20.

The pulse combustor is also provided with supply means 22 which feeds air and fuel into the combustion chamber 12. The supply means 22 includes an air supply pipe 24 and a fuel supply pipe 26 which are coupled to the casing 10. One end of each supply pipe opens into the mixing chamber 14. The air supply pipe 24 is connected with an air-side valve mechanism 28, a suction muffler 30, and a blast fan (not shown). A fuel-side valve mechanism 32 is connected to the fuel supply pipe 26.

This valve mechanism can be used to supply any combustion material to the combustion chamber. In this embodiment the combustion liquids are air and fuel. The air-side valve mechanism 28 will now be described in detail.

Figure 2:
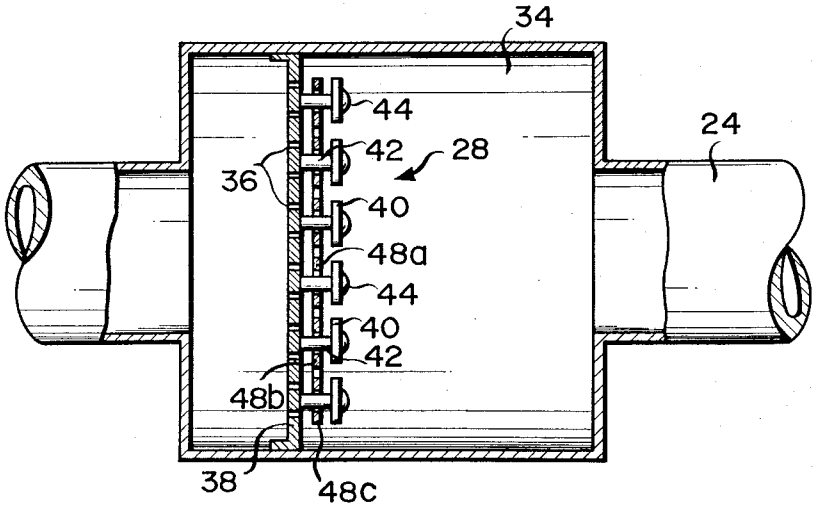
Figure 4:
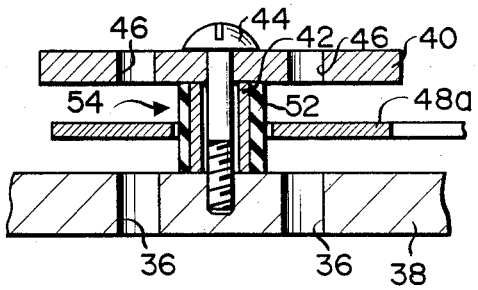

As shown in FIG. 2, the middle portion of the air supply pipe 24 is diametrically extended to form a cylindrical air chamber 34. The valve mechanism 28 includes a disk-shaped base plate 38 having a curvilinear periphery and a plurality of air supply holes 36. Disposed in the air chamber 34, the base plate 38 divides the air chamber 34 into two parts; upper- and lower-course side portions. The air supply holes 36 are arranged at predetermined intervals along the circumferences of a plurality of circles concentric with one another. As shown in FIGS. 2 and 4, a plurality of valve guards 40 are arranged on the lower-course side or the combustion chamber side of the base plate 38. Each valve guard 40 is fixed through a spacer 42 to the base plate 38 by a supporting screw 44 so as to face the base plate 38 at a space therefrom. The spacer 42is in the form of a hollow cylinder through which extends the supporting screw 44. Each valve guard 40 is formed with a plurality of pressure propagation holes 46.

Figure 3:
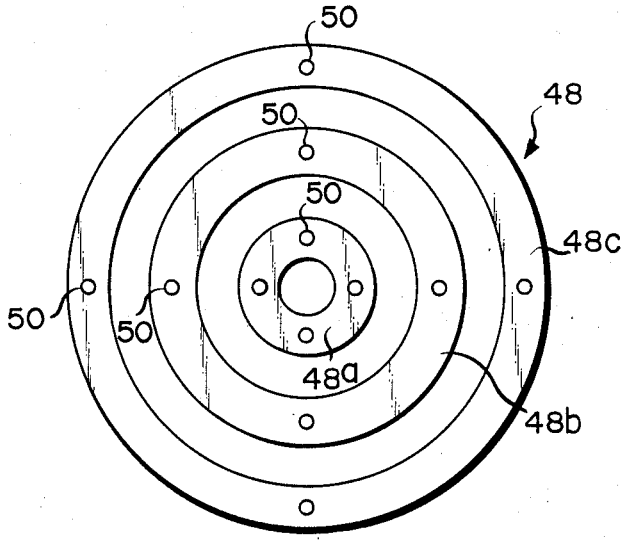

A flapper valve 48 for opening and closing the air supply holes 36 is interposed between the base plate 38 and the valve guards 40. As shown in FIGS. 2 to 4, the flapper valve 48 includes a plurality of ring-shaped segments 48*a*, 48*b* and 48*c* with different diameters which are each formed of a thin, Teflon-coated glass-fiber bundle. The segments 48*a*, 48*b* and 48*c* are concentric with one another. Each segment is formed with a plurality of apertures 50, e.g., four in number, arranged circumferentially at regular intervals. The spacers 42 of the individual valve guards 40 are inserted in their corresponding apertures 50. Thus, the segments 48*a*, 48*b* and 48*c* are restrained from moving diametrically and allowed to move only in the axial direction of the spacers 42. Here it is to be understood that the segments 48*a*, 48*b* and 48*c* of the flapper valve 48 are opposed to the air supply holes 36.

A smooth, ring-shaped elastic member 52 formed of, e.g., rubber or plastic material, is fitted on the outer periphery of each spacer 42. The elastic members 52 constitute wear preventing means 54 for protecting the contact portions of the flapper valve 48 on the spacers 42 against wear.

The fuel-side valve mechanism 32 has the same construction as the air-side valve mechanism 28 described above, and its description is omitted herein.

The operation of the pulse combustor with the aforementioned construction will now be described.

At the start of the operation of the pulse combustor, air is fed through the suction muffler 30, the air-side valve mechanism 28, and the air supply pipe 24 into the mixing chamber 14 by the blast fan (not shown). At the same time, fuel is fed into the mixing chamber 14 through the fuel-side valve mechanism 32 and the fuel supply pipe 26. The fed air and fuel are mixed in the mixing chamber 14 and the resultant gas misture flows into the combustion chamber 12 to be ignited by the ignition plug 15. As a result, the air-fuel mixture gas deflagrates, producing a positive pressure in the combustion chamber 12. Thereupon, the segments 48*a*, 48*b* and 48*c* of the flapper valve 48 are moved toward the base plate 38 to close the air supply holes 36, while the fuel-side valve mechanism 32 closes fuel supply holes (not shown). Thus, the combustion gas in the combustion chamber 12 is discharged through the tail pipe 16, decoupler 17, heat exchanger 18, exhaust muffler 19, and exhaust pipe 20.

When the combustion gas in the combustion chamber 12 is exhausted, the pressure inside the combustion chamber 12 becomes negative. As a result, the segments 48*a*, 48*b* and 48*c* of the flapper valve 48 are attracted to the valve guards 40 to cause the air supply holes 36 to open, while the fuel-side valve mechanism 32 opens the fuel supply holes. Then, the air and fuel are sucked into the combustion chamber 12 via the mixing chamber 14. At the same time, part of the high-temperature combustion gas discharged into the tail pipe 16 flows back into the combustion chamber 12, and the mixture gas in the combustion chamber 12 is ignited by the combustion gas to deflagrate. Thereafter, the deflagration in the combustion chamber 12 is pulsatively repeated, following the same procedure.

In the pulse combustor constructed in this manner, the flapper valve 48 is formed of a plurality of segments 48*a*, 48*b* and 48*c*, each of which is light in weight and can operate smoothly, following pulse oscillation. Accordingly, the pulse combustor can be improved in combustion efficiency. Arranged concentrically, the segments 48*a*, 48*b* and 48*c* can readily be aligned with one another, permitting compact design. Also, each segment of the flapper valve is narrower in surface area as compared with a conventional flapper valve of an integral type and therefore less susceptible to uneven pressure. Thus, the segments are less deformable and their life is increased. The capacity of the pulse combustor can readily be increased by providing another ring-shaped segment with a greater diameter outside the outermost existing segment 48c and forming supply holes in those regions of the base plate 38 facing the additional segment. Further, each segment can economically be used in common in pulse combustors of different capacities. If one of the segments is damaged, moreover, it can be replaced without necessitating the replacement of the remaining segments. Provided in the middle portion of the air supply pipe or the fuel supply pipe, in this embodiment, the flapper valve 48 cannot easily be affected by heat.

In this embodiment, moreover, the elastic members 52 are fitted on their corresponding spacers 42, so that the segments of the flapper valve 48 are prevented from directly touching the metallic spacers 42. Accordingly, even if the flapper valve 48 oscillates between the base plate 38 and the valve guards 40 at a relatively high speed, caused by the change of pressure inside the combustion chamber 12, the contact portions of the segments 48*a*, 48*b*, 48*c* on the spacers 42 can be protected against wear or deformation. Thus, the flapper valve 48 may be improved in durability. Fitted on the outer peripheries of their corresponding spacers 42, moreover, the elastic members 52 can easily be replaced with new ones. Furthermore, the working noise of the flapper valve can be limited to a lower level than that of its prior art counterpart. Thus, the pulse combustor, as a whole, can be reduced in noise.

Figure 5:
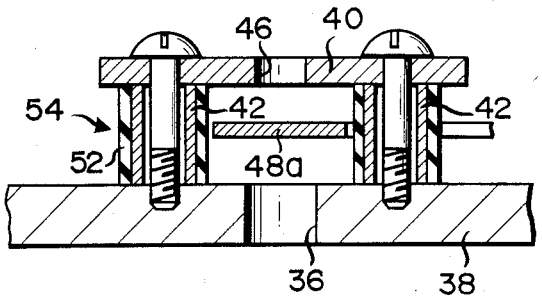
FIGS. 5 and 6 are sectional views showing modifications of the valve mechanism.
Figure 6:
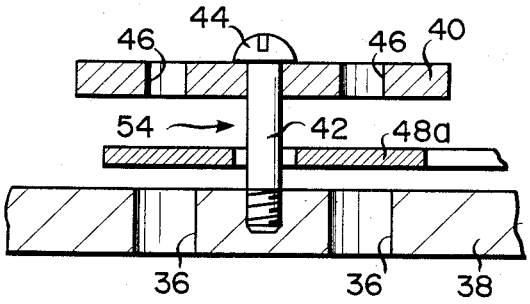

It is to be understood that the present invention is not limited to the embodiment described above, and that various changes and modifications may be effected therein by one skilled in the art without departing from the scope or spirit of the invention. In the above embodiment, for example, the diametrical movement position of each segment is regulated by inserting spacers into apertures in the segment. Alternatively, as shown in FIG. 5, the position of the segment may be regulated by providing the spacers 42 on both the inner and outer peripheral sides of the segment. The wear preventing means 54 may be formed by applying an elastic material to the peripheral surface of each spacer by coating or adhesive bonding. As shown in FIG. 6, moreover, the supporting screws 44 may be formed from synthetic resin so that they can serve both as wear preventing means and spacers.

Figure 7:
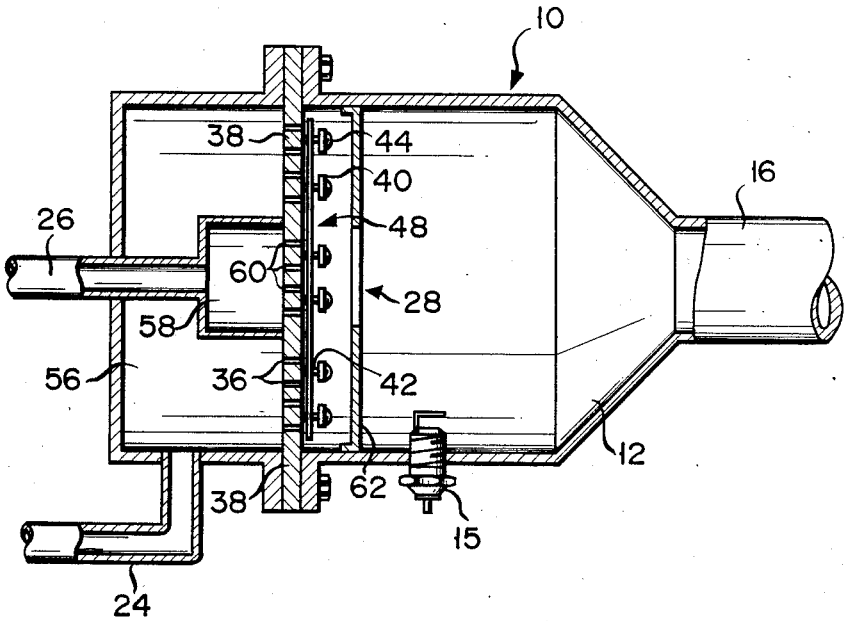
FIG. 7 is a sectional view of a pulse combustor according to another embodiment of the invention.

In the first embodiment, the valve mechanisms are provided in the air supply pipe 24 and the fuel supply pipe 26. As in an alternative embodiment shown in FIG. 7, however, a valve mechanism 28 may be provided in a combustion chamber 12. In this second embodiment, a base plate 38 is disposed in a casing 10 so as to divide the interior of the casing 10 into two parts; the combustion chamber 12 communicating with a tail pipe 16 and an air chamber 56 communicating with an air supply pipe 24. A fuel supply pipe 26 extends through the air chamber 56 to be coupled to the base plate 38, defining a fuel chamber 58 beside the base plate 38. The base plate 38 is formed with a plurality of air supply holes 36 at the outer peripheral portion communicating with the air chamber 56 and a plurality of fuel supply holes 60 at the central portion communicating with the fuel chamber 58. A plurality of valve guards 40 are fixed to the combustion chamber side of the base plate 38 with spacers 42 interposed for spacing between the valve guards 40 and the base plate 38. A flapper valve 48 for opening and closing the air supply holes 36 and the fuel supply holes 60 is disposed between the base plate 38 and the valve guards 40. As in the first embodiment, the flapper valve 48 is formed of a plurality of ring-shaped segments which are arranged concentrically and restrained from moving diametrically by the spacers 42. Numeral 62 designates a baffle plate which is opposed to the base plate 38.

In this embodiment, the same effect as the first embodiment can be obtained.

What is claimed is:

1. A pulse combustor comprising:

a casing having a combustion chamber therein;

supply means for supplying a combustion material to the combustion chamber, said combustion material including air and fuel;

valve means for controlling the combustion material supply to the combustion chamber, said valve means including a base plate with a plurality of supply hole means for the passage of the combustion material, and flapper vlvemeans for opening and closing the supply holes in accordance with the change of pressure inside the combustion chamber, said flapper valve means including a plurality of concentrically arranged ring-shaped segments of a substantially curvilinear inner and outer shape which define different areas, and each of said segments being formed with guide holes, spaced diametrically;

a plurality of spacers, extending from the base plate and inserted into the corresponding guide holes, for allowing said segments to move only in its axial direction, but not in any other direction; and a plurality of valve guards, mounted on the extended ends of the spacers, each for preventing the corresponding segment from leaving the spacers.

2. The pulse combustor according to claim 1, wherein one of said supply means includes an air supply pipe communicating with the combustion chamber and permitting the passage of air, said valve means being disposed in the air supply pipe.

3. The pulse combustor according to claim 2, wherein said base plate is disposed in the air supply pipe to partition the interior of the air supply pipe into first and second side portions and is formed with a plurality of air supply holes for the passage of the air, and said flapper valve means opens and closes the air supply holes in accordance with the change of pressure inside the combustion chamber.

4. The pulse combustor according to claim 1, wherein each of said spacers is in the form of a hollow cylinder extending away from the base plate in a substantially perpendicular direction.

5. The pulse combustor according to claim 1, wherein said valve means includes wear preventing means, coupled to said spacers, for protecting the contact portions of the segments with the spacers against wear.

6. The pulse combustor according to claim 5, wherein each of said spacers is in the form of a hollow cylinder extending at right angles to the base plate, and said wear preventing means includes elastic members fitted individually on outer peripheries of the spacers.

7. The pulse combustor according to claim 5, wherein each of said spacers is formed of a supporting screw of synthetic resin screwed into the base plate through the valve guard, said supporting screw constituting said wear preventing means.

8. The pulse combustor according to claim 1, wherein said base plate is disposed in the casing to partition the interior of the casing into a combustion chamber, and an air chamber on a first side of the combustion chamber, and said supply holes include a plurality of air supply holes for the passage of the air and a plurality of fuel supply holes for the passage of the fuel, said flapper valve means being disposed on a combustion chamber side of the base plate to open and close the air supply holes and the fuel supply holes in accordance with the change of pressure inside the combustion chamber, and said supply means includes an air supply pipe communicating with the air chamber to supply the air chamber with the air, and a fuel supply pipe penetrating the air chamber and communicating with the fuel supply holes.

9. A pulse combustor comprising:

a casing having a combustion chamber therein;

supply means for supplying both air and fuel to the combustion chamber;

air side valve means for controlling the air supply to the combustion chamber, said air valve means including a base plate with a plurality of air supply holes therein which allow the passage of air, and an air side flapper valve which opens and closes the air supply holes in accordance with a change of pressure inside the combustion chamber and which has a plurality of concentrically arranged ring-shaped segments with different diameters, each segment being formed with guide holes spaced diametrically, a plurality of spacers, extending from the base plate and inserted into the corresponding guide holes, for allowing the segments to move in its axial direction, but not in any other direction, and a plurality of valve guards, mounted on the extended ends of the spacers, each for preventing corresponding segment from leaving the spacer;

fuel side valve means for controlling the fuel supply to the combustion chamber, said fuel side valve means including a base plate with a plurality of fuel supply holes therein for the passage of fuel, a fuel side flapper valve for opening and closing the fuel supply holes in accordance with a change of pressure inside the combustion chamber and which has a plurality of concentrically arranged ring-shaped segments with different diameters, each segment being formed with guide holes spaced diametrically, a plurality of spacers, extending from the base plate and inserted into the corresponding guide holes, for allowing the segments to move in its axial direction, but not in any other direction, and a plurality of valve guards, mounted on the extended ends of the spacers, each for preventing the segments from leaving the spacer.

10. The pulse combustor according to claim 9, wherein said supply means includes a fuel supply pipe communicating with the combustion chamber which permits the passage of the fuel, said fuel side valve mechanism being disposed in the fuel supply pipe.

11. The pulse combustor according to claim 9, wherein said base plate of the air side valve mechanism is disposed in the air supply pipe to partition the interior of the air supply pipe into a combustion-chamber side portion and an opposite side portion.

12. The pulse combustor according to claim 9, wherein said base plates of the air and fuel side valve mechanisms are formed integrally and disposed in the casing to partition the interior thereof into a combustion chamber and an air chamber; said fuel supply holes are formed at the central portion of said integral base plate; said air supply holes are formed around the fuel supply holes; said air and fuel side flapper valves being disposed on the combustion chamber side of the base plate to be coaxial therewith; and said supply means including an air supply pipe communicating with the air chamber and a fuel supply pipe penetrating the air chamber and communicating with the fuel supply holes.

13. The pulse combustor according to claim 9, wherein said supply means includes an air supply pipe communicating with the combustion chamber and permitting the passage of the air, said air side valve mechanism being disposed in the air supply pipe.

14. The pulse combustor according to claim 9, wherein said air side valve mechanism includes wear preventing means for protecting the contact portions of the segments on the spacers against wear.

15. The pulse combustor according to claim 14, wherein each of said spacers is in the form of a hollow cylinder having an outer periphery and extending at right angles to the base plate, and said wear preventing means includes elastic members fitted individually on the outer peripheries of the spacers.

* * * * *